US007082889B2

(12) United States Patent
Clark

(10) Patent No.: US 7,082,889 B2
(45) Date of Patent: Aug. 1, 2006

(54) FLAG DISPLAY DEVICE

(76) Inventor: Michael Bruce Clark, 260 Mahoning Dr., East, Lehighton, PA (US) 18235

( * ) Notice: Subject to any disclaimer, the term of this patent is extended or adjusted under 35 U.S.C. 154(b) by 0 days.

(21) Appl. No.: 11/007,467

(22) Filed: Dec. 8, 2004

(65) Prior Publication Data

US 2006/0118029 A1 Jun. 8, 2006

(51) Int. Cl.
*G09F 17/00* (2006.01)

(52) U.S. Cl. ..... 116/174; 116/173; 248/534; 248/218.4

(58) Field of Classification Search ..... 116/173, 116/174, 175; D20/10, 40; D11/165, 166, D11/181, 182, 183; 248/218.4, 534, 219.1, 248/219.4, 227.3, 520; 40/607.09, 607.12, 40/617; 362/431, 253, 103
See application file for complete search history.

(56) References Cited

U.S. PATENT DOCUMENTS

| | | | | | |
|---|---|---|---|---|---|
| 643,945 | A | * | 2/1900 | Clifford | 116/173 |
| 839,272 | A | * | 12/1906 | Crow | 52/697 |
| 957,606 | A | | 5/1910 | Hendricks | |
| 1,171,917 | A | | 2/1916 | Axford | |
| 1,256,232 | A | | 2/1918 | Howard | |
| 1,258,022 | A | | 3/1918 | Kray | |
| 1,338,210 | A | * | 4/1920 | Buckley | 116/173 |
| 1,680,703 | A | * | 8/1928 | Sullivan | 116/173 |
| 1,712,691 | A | * | 5/1929 | Carlson | 116/174 |
| 1,740,747 | A | | 12/1929 | Price | |
| 1,760,337 | A | * | 5/1930 | Bernardin | 116/173 |
| 1,878,447 | A | | 9/1932 | Sutphen | |
| 3,476,929 | A | | 11/1969 | Klinger | |
| 3,638,891 | A | * | 2/1972 | Schlosser | 248/230.5 |
| 3,680,526 | A | * | 8/1972 | Buffington, Jr. | 116/174 |
| 3,752,975 | A | | 8/1973 | Meyer | |
| 4,553,430 | A | | 11/1985 | Behrens | |
| 4,554,885 | A | * | 11/1985 | Burny, Jr. | 116/174 |
| 4,850,798 | A | * | 7/1989 | Bailey | 416/11 |
| 4,967,685 | A | * | 11/1990 | Beck | 116/173 |
| 5,070,809 | A | * | 12/1991 | Fox et al. | 116/174 |
| 5,161,874 | A | * | 11/1992 | Benes | 362/552 |
| 5,315,955 | A | * | 5/1994 | Feliz | 116/173 |
| 5,335,621 | A | * | 8/1994 | Willis et al. | 116/173 |
| 5,402,746 | A | * | 4/1995 | Deschamps | 116/174 |
| 5,597,226 | A | | 1/1997 | Fast | |
| 5,809,930 | A | | 9/1998 | Brooks | |
| 5,988,100 | A | | 11/1999 | Schmitt | |
| 6,227,683 | B1 | | 5/2001 | Tukia | |
| 6,520,665 | B1 | * | 2/2003 | Scandle | 362/431 |
| 2003/0193804 | A1 | | 10/2003 | Schroeder | |
| 2004/0134411 | A1 | | 7/2004 | Lawrence | |

* cited by examiner

*Primary Examiner*—Diego Gutierrez
*Assistant Examiner*—Amy R. Cohen
(74) *Attorney, Agent, or Firm*—Henry L. Smith, Jr.

(57) ABSTRACT

A device and method for displaying a flag at night under a light, wherein the flag is attached to a vertical rope, and a weight is attached to the bottom of the rope. The rope and flag can be easily raised or lowered, and the flag will fly in any wind direction without becoming wrapped around a supporting pole.

29 Claims, 4 Drawing Sheets

FLAG DISPLAY DEVICE

BACKGROUND

1. Field of Invention

The field of the invention is a group of devices and methods for displaying a flag flying in the air, especially at night.

2. Description of Prior Art

Over the years many, many devices have been invented for flying a flag. Representative of prior art are the following patents, none of which is very similar to the present invention. U.S. Pat. No. 957,606 to Hendricks and Burnap, May 10, 1910, discloses a device for flying a flag in which the halyards can rotate with the flag around the pole when the wind direction changes to avoid the flag's being wrapped around the pole. U.S. Pat. No. 1,171,917 to Axford, Feb. 15, 1916, discloses a device for flying a flag involving light bulbs in a half cylinder which can rotate with the flag. U.S. Pat. No. 1,878,447, Feb. 20, 1931, to Sutphen discloses an illuminated flag pole with a transparent upper portion and light source in it to shine on the flag in any wind direction. These patents and many similar ones involve complex mechanical parts and specially made lighting fixtures. They are obviously more complex and expensive to make and use than the present invention.

SUMMARY OF INVENTION

The invention is a device and method for displaying a flag at night when it would be illuminated by a light. In essence, the invention is a device for displaying a flag under a light in a manner so that the flag will properly fly in a wind of any direction and will not be wrapped around a traditional flagpole by a change of wind direction. Essentially the edge of the flag is attached to a vertical rope threaded through and suspended from C-shaped bracket. A weight is attached to the rope near the bottom edge of the flag. The weight causes the rope to which the edge of the flag is attached to remain substantially vertical no matter which direction the wind is coming from or how strong the wind may be, within reasonable limits. Swivel clips on the rope, above and below the flag edge attachment area, allow the portion of the rope to which the flag edge is attached to freely rotate in the wind. The rope with the flag attached can easily be lowered by a person on the ground for attachment of the flag to the rope, or removal of the flag from the rope. A person on the ground can easily elevate the flag by pulling on the rope, so that the flag is positioned near the top of the support pole and under a light.

OBJECTS AND ADVANTAGES

The objects and advantages of the present invention are:

1. To provide a device for displaying a flag at night under a light.

2. To provide a device for easily raising and lowering a flag, and positioning it under a light so that it will be illuminated at night.

3. To provide a device which will allow a flag to properly fly in a wind of any direction without wrapping itself around a flagpole, or other support.

4. To provide a device for displaying one or more flags as discussed above, wherein the flags are positioned in a vertical configuration and where the edge of one flag is attached to the rope under the flag above.

5. To provide a device for displaying a flag at night under a light which is simple to construct.

6. To provide a device as in 5 above which is cheap to manufacture.

7. To provide a device for displaying a flag at night which can be easily attached to many kinds of poles or vertical supports.

8. To provide a method for easily displaying a flag at night, and raising and lowering it.

DRAWING FIGURES

FIG. 1 shows the basic device by which a flag may be attached to a tall supporting pole, not shown. The device comprises essentially an L-shaped support member 2, to which a substantially C-shaped hollow pipe (parts 4, 5, and 7) is attached.

REFERENCE NUMERALS IN DRAWINGS

Figure 1:
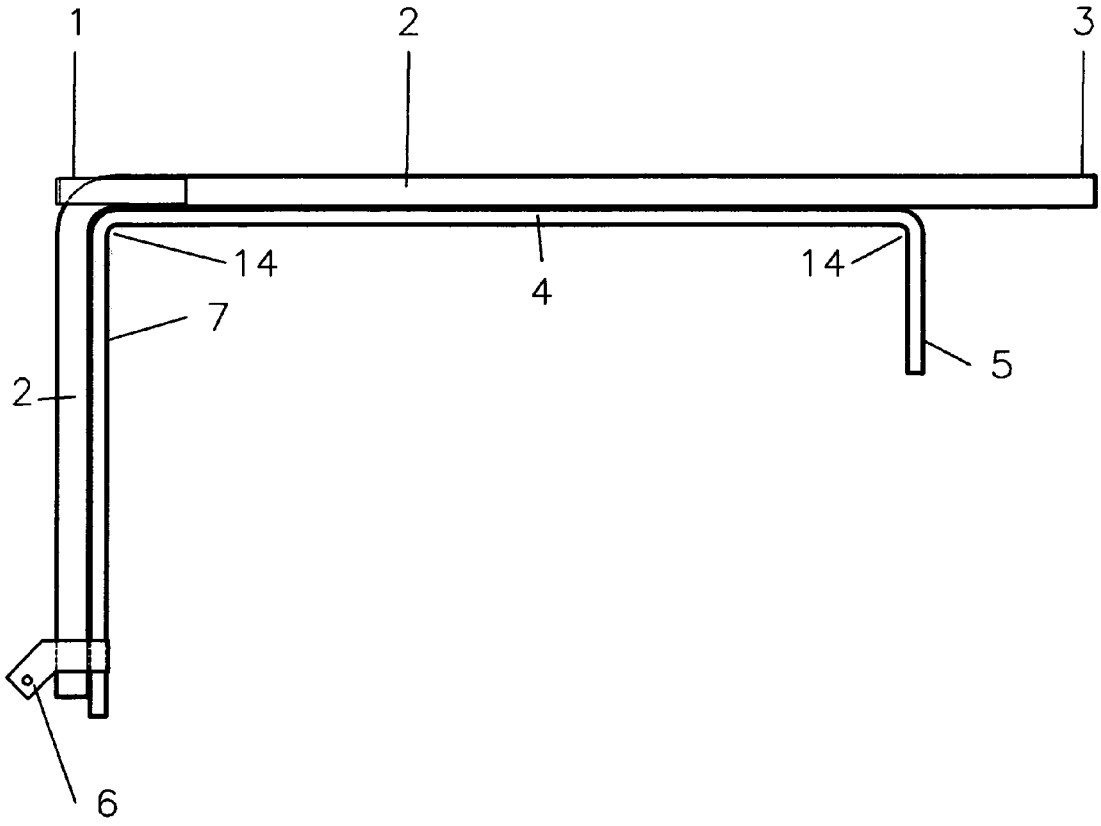

1. top bolt hole bracket
2. L-shaped support member
3. light mounting area
4. horizontal pipe area
5. shorter vertical pipe area
6. lower mounting bracket
7. longer vertical pipe area
8. swivel clip
9. rope or chain or cable
10. weight
11. rope cleat
12. support pole
13. light
14. 90 degree bend
15. flag
16. bolt
17. bolt hole
18. nut

DETAILED DESCIPTION OF THE DRAWINGS

FIG. 1 shows the basic structure of the invention including the L-shaped support member 2 and the C-shaped pipe means (which could also include an open U-shaped channel instead of a completely closed tube) comprising horizontal pipe area 4, shorter vertical pipe area 5 and longer vertical pipe area 7. The L-shaped support member 2 could comprise a hollow pipe typically 1½ inches in diameter, or it could be made of a piece of metal of substantially square or rectangular cross-section. At one end of the L-shaped support member 2 is attached a top bolt hole bracket 1 for attachment to a support pole not shown, and at the other end is the light mounting area 3 where a light fixture may be mounted. Attached underneath the L-shaped support member 2 is a substantially C-shaped pipe comprising horizontal pipe area 4, shorter vertical pipe area 5 and longer vertical pipe area 7. The C-shaped pipe could be attached to the L-shaped support member by welding or other attachment means. The C-shaped pipe involves two 90 degree bends 14. The C-shaped pipe comprising parts 7, 4, and 5, is a hollow tube. Lower mounting bracket 6 is also shown attached to part 2 and 7. It contains a small hole through which a bolt could pass to secure it to the support pole not shown.

Figure 2:
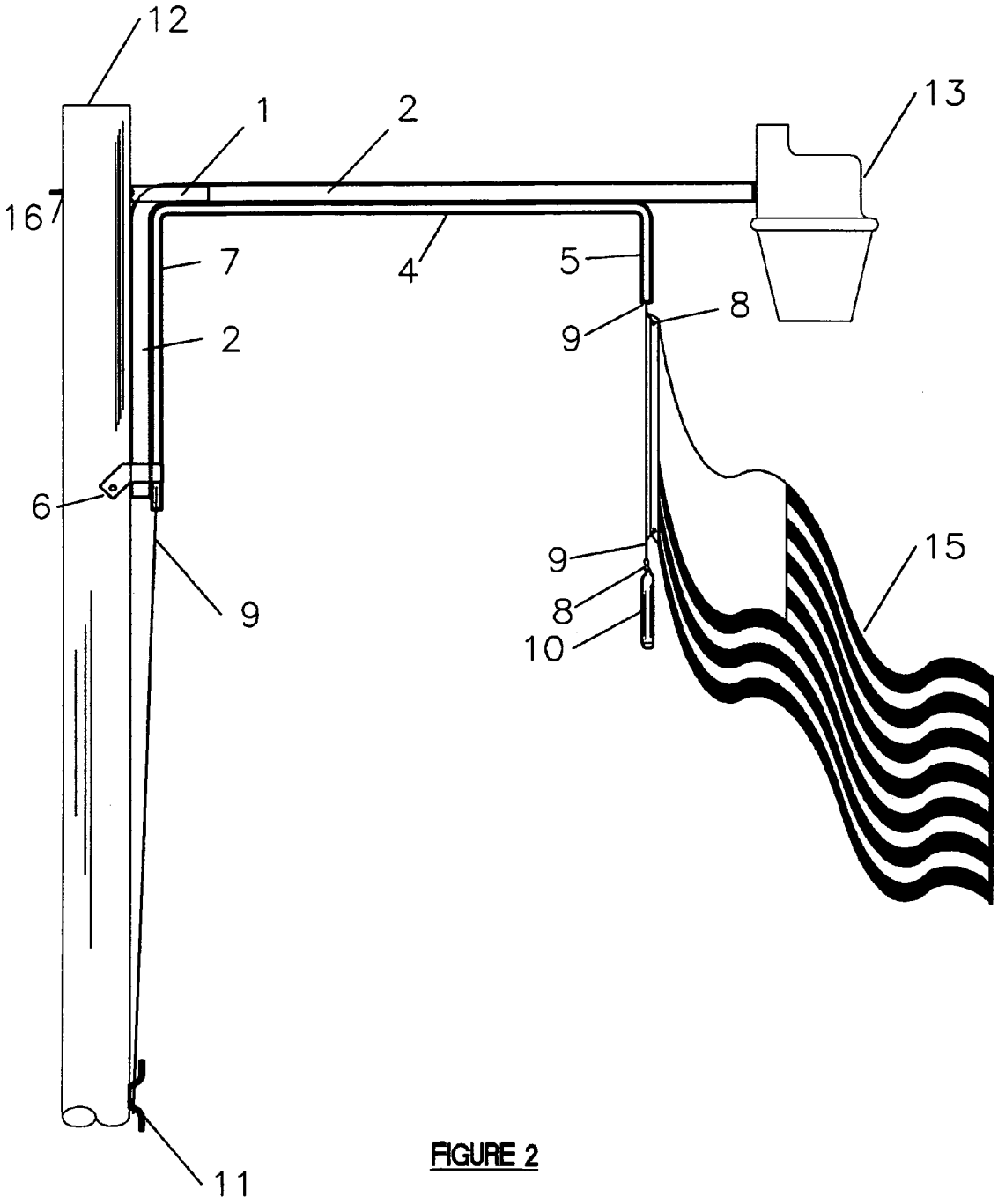
FIG. 2 shows a flag, the edge of which is attached to a rope, which rope goes through the hollow C-shaped pipe. A weight 10 at the bottom end of the rope creates enough tension in the rope for the flag to fly properly in a horizontal direction in a wind of any direction.

FIG. 2 shows the L-shaped support member 2 attached to support pole 12 by means of top bolt hole bracket 1 and lower mounting bracket 6. Rope or chain or cable 9 is shown attached to the rope cleat 11 (or other means for securing the flexible flag suspension means to the support pole), passing upward and entering the longer vertical pipe area 7, passing through horizontal pipe area 4 and passing downward through vertical pipe area 5. The edge of flag 15 is attached to rope 9 (or other flag attachment means such an elongated rod or strip of substantially inflexible material) by clips or other attachment means well known to those skilled in the art. Between the shorter vertical pipe area 5 and the top edge of the flag is a swivel clip 8 (or other swivel means), well known to those skilled in the art, which allows the portion of rope 9 to which the flag 15 is attached to swivel with respect to the rest of the rope 9. Likewise beneath the flag 15 is another swivel clip 8 between the rope 9 and the weight 10. A light 13 is shown attached to the right end (light mounting area 3) of L-shaped support member 2. This provides light by shining down on flag 15. The lower mounting bracket 6 is shown attached to support pole 12 by means of a bolt or screw (not shown) passing thought its hole and into support pole 12. The top bolt hole bracket 1 is attached to the support pole 12 by bolt 16. The ground or other operator person surface (not shown) is at the bottom of support pole 12.

Figure 3:
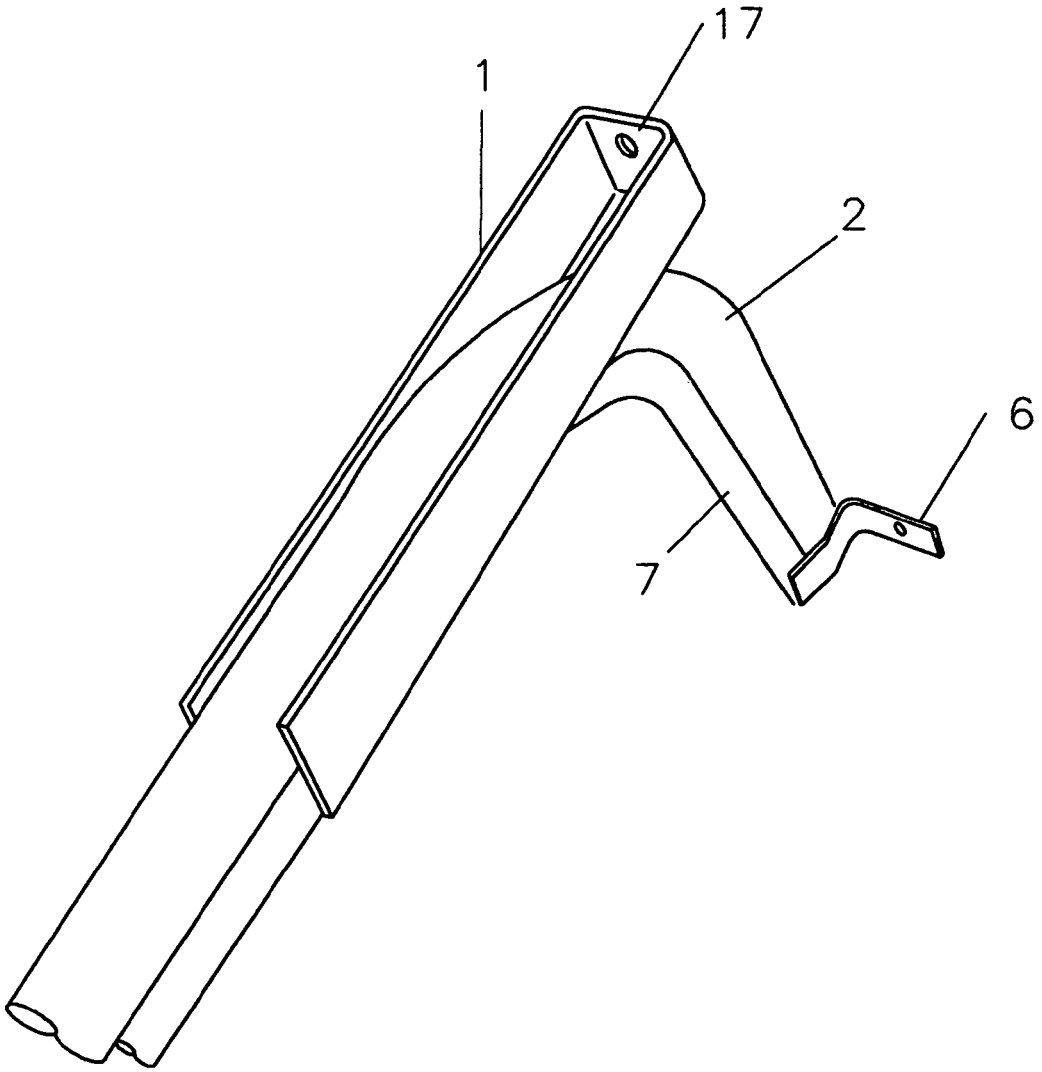
FIG. 3 shows a perspective view of the top bolt hole bracket and related pipes.

FIG. 3 shows the top bolt hole bracket 1 welded to L-shaped support member 2 which is welded to longer vertical pipe area 7. Also show attached is lower mounting bracket 6. Bolt hole 17 receives a bolt 16 not shown which attaches the assembly to the support pole 12 not shown.

Figure 4:
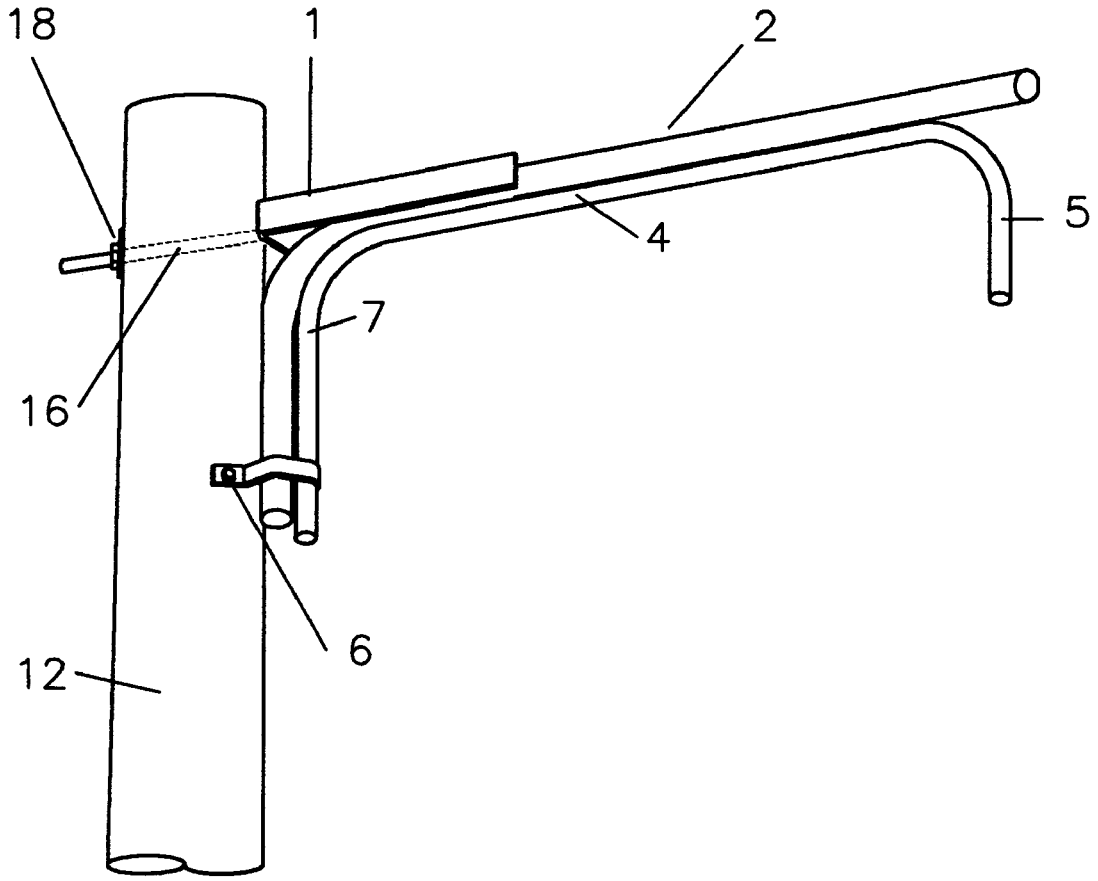
FIG. 4 shows how the top bolt hole bracket and L-shaped support member are attached to the support pole 12.

FIG. 4 shows how the L-shaped support member 2 is attached to support pole 12 by means of bolt 16 which passes through bolt hole 17 in FIG. 4. The lower mounting bracket 6 is also attached to the support pole 12 by a bolt or screw (not shown) passing through a hole in lower mounting bracket 6. The end of bolt 16 is secured to the support pole 12 by a nut 18.

DESCRIPTION—PREFERRED EMBODIMENT

The preferred embodiment of the invention is as described above. The L-shaped support member 2 is typically 1½ inch pipe of any suitable metal which can be bent 90 degrees, yet retain its strength in the bent configuration. However, the L-shaped bracket could also be made of solid metal capable of being formed in an L-shape. The pipe comprising parts 4, 5, and 7 would typically be of a suitable metal adapted for welding to the L-shaped bracket. These matters are well known to those skilled in the art. This pipe would typically be ¾ or 1 inch in diameter, depending on the thickness of rope 9 desired. The dimensions of other parts are variable depending on the size and weight of the flag, desired height for the flag, etc. The weight of weight 10 would typically be 5 to 10 pounds or more, but that could vary depending on the size, weight and wind resistance of the flag, the number of flags, the expected wind velocity, etc. A heavier weight would be used for a larger flag, more flags, or higher wind velocity. The L-shaped bracket (or other support member means such as brackets of other shapes) could also be attached to support pole 12 (or other flag support means such as the corner or other portion of a building) by other means known to those skilled in the art including screws, bands, clamps, etc. The light 13 could be a normal incandescent bulb or mercury vapor or sodium vapor bulb. It could be controlled by a switch near the ground or by a photocell which would turn it on at night.

Operation of the Invention

Before the L-shaped support member 2, together with C-shaped pipe comprising parts 4, 5, and 7 are attached to support pole 12, a rope 9 (or other flexible flag suspension means such as a chain or cable) is threaded through the C-shaped pipe. The weight 10 is attached to the end of rope 9 as shown in FIG. 3. When the L-shaped support member 2 is attached to support pole 12, the weight 10 can hold down the rope 9 within the reach of a person on the ground. The person then attaches flag 15 to the portion of rope 9 between the two swivel clips 8. The person can then go over to the portion of the rope 9 next to support pole 12, pull down the rope and raise the flag 15 to a position underneath the light 13. The rope 9 is then secured to rope cleat 11. Because the weight 10 can create substantial tension in the rope 9 and cause the portion of rope 9 to which the edge of the flag is attached to remain substantially vertical, the flag 15 can fly in any horizontal direction depending on the wind direction, without wrapping itself around the support pole 12 or the rope 9, since the portion of the rope 9 to which the flag is attached can rotate between the two swivel clips 8. Potentially, one or more flags could be attached to the rope 9 under the top flag. The weight 10 is selected to be heavy enough to produce enough tension on the rope 9 to keep the rope 9 substantially vertical, and non-swinging in the wind. The exact weight of weight is selected to be large enough to provide a stable arrangement depending on the weight and surface area of the flags attached to rope 9. If it is desired to lower the flag, a person can loosen rope 9 from rope cleat 11 and allow the flag 15 to descend, under the influence of weight 10, within reach of the person so that the flag can be detached from the rope 9.

Tests

The Inventor has tested the flag to verify that it would fly properly in a wind of any direction without wrapping itself around the tall support pole or the rope. The Inventor also verified that the flag could be easily attached to the pipe and raised to a position under a light.

Additional Embodiments

The flag, weight and rope could also be suspended from any supporting object up in the air above the ground and substantially away from any surface or object which could limit the free flying of the flag. A method for displaying and flying a flag in a wind of any direction without the flag being wrapped around a support means or being impeded by any object, would be clear to a person skilled in the art and would comprise assembling the parts described in the Figures and described in the Preferred Embodiment and Operation of the Invention sections of this Application.

CONCLUSIONS, RAMIFICATIONS AND SCOPE

A number of changes are possible to the parts described above while still remaining within the scope and spirit of the invention. The specifics about the form of the invention described in this application are not intended to be limiting in scope. The scope of the invention is to be determined by the claims and their legal equivalents, not the examples given above.

I claim:

1. A device for displaying and flying a flag above the ground or any surface where an operator person is located, comprising:

(a) a substantially C-shaped pipe means comprising a horizontal pipe means area, a shorter vertical pipe means area, and a longer vertical pipe means area, (b) a support member means attached adjacent to and parallel to the horizontal pipe means area, and adjacent to and parallel to a vertical pipe means area, of part (a) above, and adapted to secure part (a) to, and extending outward from, a support pole or other kind of flag support means above the ground or any surface where an operator person is located, (c) a rope or other flexible flag suspension means which passes from near the ground or other operator person surface upwards through one vertical pipe means area, through the horizontal pipe means area, down through the other vertical pipe means area, (d) a separate flag attachment means, the axis of which is in-line with the flexible flag suspension means of (c) above, having a top and bottom, to which an edge of a flag may be attached, (e) a separate swivel means in-line between the rope or other flexible flag suspension means and the top of the flag attachment means and connecting the flag suspension means to, and in-line with, the top of the flag attachment means (f) a separate second swivel means attached, in-line with the bottom of the flag attachment means, at or near the bottom of the flag attachment means, and (g) a weight attached at or near the second swivel means, wherein the separate second swivel means connects, and is attached in-line between, the bottom of the flag attachment means and the weight, whereby a flag can fly in a wind of any direction without wrapping itself around any support pole or other flag support means, and without being impeded by any object.

2. The device of claim 1, wherein the support member means of part (b) is an L-shaped support member.

3. The device of claim 2, wherein the flexible flag suspension means includes a cable or chain.

4. The device of claim 3, wherein the flag attachment means is a section of rope, a rod, or a strip of substantially inflexible material.

5. The device of claim 4, further comprising a light attached substantially near the end of the support member means at a position substantially over the flag.

6. The device of claim 5 further comprising a rope cleat or other means for securing the flexible flag suspension means to the support pole or other flag support means.

7. The device of claim 2 further comprising a rope cleat or other means for securing the flexible flag suspension means to the support pole or other flag support means.

8. The device of claim 2, further comprising a light attached substantially near the end of the support member means at a position substantially over the flag.

9. The device of claim 8 further comprising a rope cleat or other means for securing the flexible flag suspension means to the support pole or other flag support means.

10. The device of claim 3, further comprising a light attached substantially near the end of the support member means at a position substantially over the flag.

11. The device of claim 10 further comprising a rope cleat or other means for securing the flexible flag suspension means to the support pole or other flag support means.

12. The device of claim 3 further comprising a rope cleat or other means for securing the flexible flag suspension means to the support pole or other flag support means.

13. The device of claim 4 further comprising a rope cleat or other means for securing the flexible flag suspension means to the support pole or other flag support means.

14. The device of claim 1, wherein the flexible flag suspension means of part (c) includes a cable or chain.

15. The device of claim 14, further comprising a light attached substantially near the end of the support member means at a position substantially over the flag.

16. The device of claim 15 further comprising a rope cleat or other means for securing the flexible flag suspension means to the support pole or other flag support means.

17. The device of claim 14 further comprising a rope cleat or other means for securing the flexible flag suspension means to the support pole or other flag support means.

18. The device of claim 1, wherein the flag attachment means of part (d) is a section of rope, a rod, or a strip of substantially inflexible material.

19. The device of claim 18, further comprising a light attached substantially near the end of the support member means at a position substantially over the flag.

20. The device of claim 19 further comprising a rope cleat or other means for securing the flexible flag suspension means to the support pole or other flag support means.

21. The device of claim 18 further comprising a rope cleat or other means for securing the flexible flag suspension means to the support pole or other flag support means.

22. The device of claim 1, wherein the swivel means of part (e) is a swivel clip.

23. The device of claim 22, further comprising a light attached substantially near the end of the support member means at a position substantially over the flag.

24. The device of claim 23 further comprising a rope cleat or other means for securing the flexible flag suspension means to the support pole or other flag support means.

25. The device of claim 22 further comprising a rope cleat or other means for securing the flexible flag suspension means to the support pole or other flag support means.

26. The device of claim 1, further comprising a light attached substantially near the end of the support member means at a position substantially over the flag.

27. The device of claim 26 further comprising a rope cleat or other means for securing the flexible flag suspension means to the support pole or other flag support means.

28. The device of claim 1 further comprising a rope cleat or other means for securing the flexible flag suspension means to the support pole or other flag support means.

29. A device for displaying and flying a flag above the ground or any surface where an operator person is located, comprising:

(a) a substantially C-shaped pipe comprising a horizontal pipe area, a shorter vertical pipe area, and a longer vertical pipe area, (b) an L-shaped support member attached to the horizontal pipe area of part (a) above, and adapted to secure part (a) to, and extending outward from, a support pole above the ground or any surface where an operator person is located, (c) a rope which passes from near the ground or other operator person surface upwards through one vertical pipe area, through the horizontal pipe area, down through the other vertical pipe area, (d) a section of rope, having a top and bottom, to which an edge of a flag may be attached, (e) a separate swivel clip in-line between, and connecting, the rope and the top of the section of rope in (d), (f) a second separate swivel clip attached, in-line, at the bottom of the section of rope in (d), and (g) a weight attached at or near the second swivel clip, wherein the second swivel clip connects the bottom of the section of the rope in (d) to the weight, whereby a flag can fly in a wind of any direction without wrapping itself around any support pole, and without being impeded by any object.

* * * * *